US006694939B2

(12) United States Patent
Nomura et al.

(10) Patent No.: US 6,694,939 B2
(45) Date of Patent: Feb. 24, 2004

(54) DECOMPRESSION UNIT FOR INTERNAL COMBUSTION ENGINE

(75) Inventors: Akifumi Nomura, Saitama (JP); Yasuo Shimura, Saitama (JP); Akira Tokito, Saitama (JP); Kazuhisa Takemoto, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 163 days.

(21) Appl. No.: 10/077,952

(22) Filed: Feb. 20, 2002

(65) Prior Publication Data

US 2002/0112690 A1 Aug. 22, 2002

(30) Foreign Application Priority Data

Feb. 20, 2001 (JP) ..... 2001-043596

(51) Int. Cl.[7] ..... F01L 13/08
(52) U.S. Cl. ..... 123/182.1
(58) Field of Search ..... 123/182.1, 188.4, 123/188.11, 188.7

(56) References Cited

U.S. PATENT DOCUMENTS 3,399,659 A 9/1968 Isoda
4,394,851 A * 7/1983 Greier et al. ..... 123/182.1

FOREIGN PATENT DOCUMENTS

DE 341484 C 10/1921
DE 814808 C 7/1949
FR 748596 4/1933
GB 180 889 A 6/1922
JP 2534274 Y2 9/1997
NL 17 898 C 4/1928
NL 83 711 C 1/1957

OTHER PUBLICATIONS

Patent Abstracts of Japan, JP 59–74318 A, Apr. 26, 1984.

* cited by examiner

*Primary Examiner*—Bibhu Mohanty
(74) *Attorney, Agent, or Firm*—Birch, Stewart, Kolasch & Birch, LLP

(57) ABSTRACT

In a decompression unit including a decompression arm, a decompression unit for internal combustion engine is provided in which the followability in the opening-and-closing operation of the air intake valve or the exhaust valve with respect to the cam at high-revolution speeds is satisfactory without increasing the equivalent inertia weight of the valve driving system, and for lowering the cost. A decompression unit includes a first decompression cam that takes the operating position when the number of revolutions of the engine is not more than the predetermined number of revolution during startup. A second decompression cam is provided that takes the operating position by manual operation. A decompression arm includes first and second abutting portions that abut against first and second decompression cams, respectively. An adjusting screw is provided for pressing the rocker arm and a resilient member for bringing the first abutting portion of the decompression arm into abutment against the first decompression cam. The decompression arm pivoted by the first and the second decompression cams pivots the rocker arm via the adjusting screw to open the exhaust valve.

14 Claims, 3 Drawing Sheets

DECOMPRESSION UNIT FOR INTERNAL COMBUSTION ENGINE

CROSS-REFERENCE TO RELATED APPLICATIONS

The present application claims priority under 35 USC 119 to Japanese Patent Application No. 2001-043596 filed on Feb. 20, 2001 the entire contents thereof is hereby incorporated by reference.

BACKGROUND OF THE INVENTION

1. Field of the Invention

The present invention relates to a decompression unit for reducing compression pressure for facilitating startup when starting a reciprocating internal combustion engine.

2. Description of Background Art

Hithertofore, a decompression unit for internal combustion engines is disclosed in Japanese Utility Model Registration No. 2534274. The decompression unit is provided in an engine having an air intake rocker arm for opening two air intake valves respectively with its bifurcated extremities and includes a decompression arm inserted between one of the air inlet valves and one of the extremities of the air intake rocker arm. A decompression cam is provided for pivoting the decompression arm. At the time of startup, the decompression cam pivots the decompression arm to push one of the air intake valves to open for reducing the compression pressure. Accordingly, a reaction force of the valve spring of the air intake valve to be applied to the decompression arm and the decompression cam is applied only by one of the air intake valves and thus is reduced by half, whereby durability of the decompression cam increases and the operating force may be reduced.

In the related art, the decompression arm is inserted between the air intake rocker arm and the air intake valve. Therefore, even after the decompressing operation in which the air intake valve is opened by the decompression arm at the time of startup is released, the air intake cam always pivots the decompression arm as well as the air intake rocker arm when the air intake valve is opened and closed by the air intake cam. As a consequent, the equivalent inertia weight of the valve driving system for opening and closing the air intake valve increases by the weight corresponding to the decompression arm, and thus the followability in the opening-and-closing operation of the air intake valve with respect to the air intake cam while the internal combustion engine is operated at high-revolution speeds decreases, which results in a decrease in output of the engine. Since the decompression arm is always pivoted together with the air intake rocker arm, the decompression arm is required to have a rigidity for bearing with a pivotal motion when the internal combustion engine is operated at high-revolution speeds after startup, and to have an abrasion resistance for limiting abrasion caused by contact with the air intake rocker arm and with the air intake valve in a state in which a pressing force from the air intake cam and a reaction force of the valve spring are applied thereto, which results in a disadvantageous problem in that the cost increases.

SUMMARY AND OBJECTS OF THE INVENTION

In order to solve the problems described above, the present invention is directed in common to provide a decompression unit for internal combustion engines wherein a decompression unit including a decompression arm provides good followability in the opening-and-closing operation of the air intake valve or the exhaust valve with respect to the cam at the time of high-velocity revolution is satisfactory without increasing the equivalent inertia weight of the valve driving system, and the cost can be lowered. The present invention provides a compact decompression unit in which the decompressing operation can be performed manually even when the decompressing operation is released by automatic operation. The present invention is directed to provide a decompression unit in which the optimal decompressing operation can be performed by adjusting the valve opening period and the lifting amount.

The present invention is directed to an internal combustion engine including an air intake valve and an exhaust valve wherein the rocker arm that is pivoted by a cam provided on the cam shaft that is driven by the power of the crankshaft opens and closes the air intake valve or the exhaust valve, a decompression unit for an internal combustion engine comprising a first decompression cam that takes the operating position when the number of revolutions of the engine is not more than the predetermined number of revolutions during startup. A decompression arm is supported by the internal combustion engine for a pivotal motion and includes a first abutting portion for abutting against the first decompression cam and a pressing portion for pressing the rocker arm. A resilient member applies a resilient force so that the first abutting portion of the decompression arm is brought into abutment against the first decompression cam, wherein the decompression arm is pivoted by the first decompression cam located at the operating position against the resilient force for allowing the rocker arm to pivot via the pressing portion for opening the air intake valve or the exhaust valve.

According to the present invention, since the resiliency of the resilient member acts on the decompression arm so that the decompression arm moves away from the rocker arm, the decompression arm is pivoted together with the rocker arm for pivoting the rocker arm only when it is pivoted by the first decompression cam located at the operating position, but the decompression arm is not pivoted together with the rocker arm when the rocker arm is pivoted by the cam. Therefore, the following effects are achieved. Since the decompression arm is pivoted with the rocker arm only when it is pivoted by the decompression cam during the decompressing operation, but is not pivoted when the rocker arm is pivoted by the cam and when the decompressing operation is released, the provision of the decompression arm does not increase the equivalent inertia weight of the valve operation system for opening and closing the air intake valve or the exhaust valve, and thus the followability of the air intake valve and the exhaust valve in the opening-and-closing operation with respect to the cam is satisfactory when the internal combustion engine E is operated at high-revolution speeds, thereby preventing a lowering of the output of the engine. Since the number of revolutions of the engine at which the decompression arm is pivoted is not more than the predetermined number of revolutions during startup, which belongs to the extremely low revolution range in the operational revolution range of the internal combustion engine, the requirements for the rigidity of the decompression arm are not strict. In addition, since abrasion caused by contact with the rocker arm is seen only during the decompressing operation, the requirements for abrasion resistance are also not strict. Therefore, the cost of the decompression unit can be reduced by using less expensive materials or by omitting the surface treatment while ensuring the durability.

The present invention includes a decompression unit for an internal combustion engine wherein the decompression unit comprises a second decompression cam that takes the operating position by a manual operation. The decompression arm includes the second abutting portion that abuts against the second decompression cam, and the decompression arm pivoted against the resilient force by the above-described second decompression cam located at operating position pivots the rocker arm via the pressing portion to open the air intake valve or the exhaust valve.

According to the present invention the decompressing operation can be performed by the second decompression cam that is to be operated manually even in the operational revolution range in which the decompressing operation of the first decompression cam is released. Therefore, the following effects are achieved in addition to the effects of the present invention, the decompressing operation can be performed manually even when the automatic decompressing operation based on the number of revolutions of the engine is released. Accordingly, when a state in which an unburned air-fuel mixture exists in the combustion chamber occurs, for example, if an accidental fire due to a concentrated air-fuel mixture supplied during startup occurs when the internal combustion engine in a state in which the decompressing operation by the first decompression cam is released is operated, the unburned air-fuel mixture can be scavenged quickly by the decompressing operation via the second decompression cam so that the normal operating state such as a restart or the like is restored. In addition, since the decompression arm can be used in common in the automatic operation and the manual operation, the decompression unit can be downsized.

The present invention provides a pressing portion comprises an adjusting member being capable of adjusting the space with respect to the abutting portion of the rocker arm that abuts against the pressing portion.

According to the present invention, since the space between the pressing portion of the decompression arm and the abutting portion of the rocker arm can be adjusted, the opening-and-closing timings, the valve opening periods, and the lifting amounts of the air intake valve or the exhaust valve by the decompression arm can easily be adjusted at the time of the decompressing operation. Therefore, the optimal decompressing operation can be performed for each internal combustion engine, and the decompression unit can be used in common for a variety of internal combustion engines, which enables a cost reduction by mass production of the decompression unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Referring now to FIG. 1 to FIG. 4, one embodiment of the present invention will be described.

Figure 1:
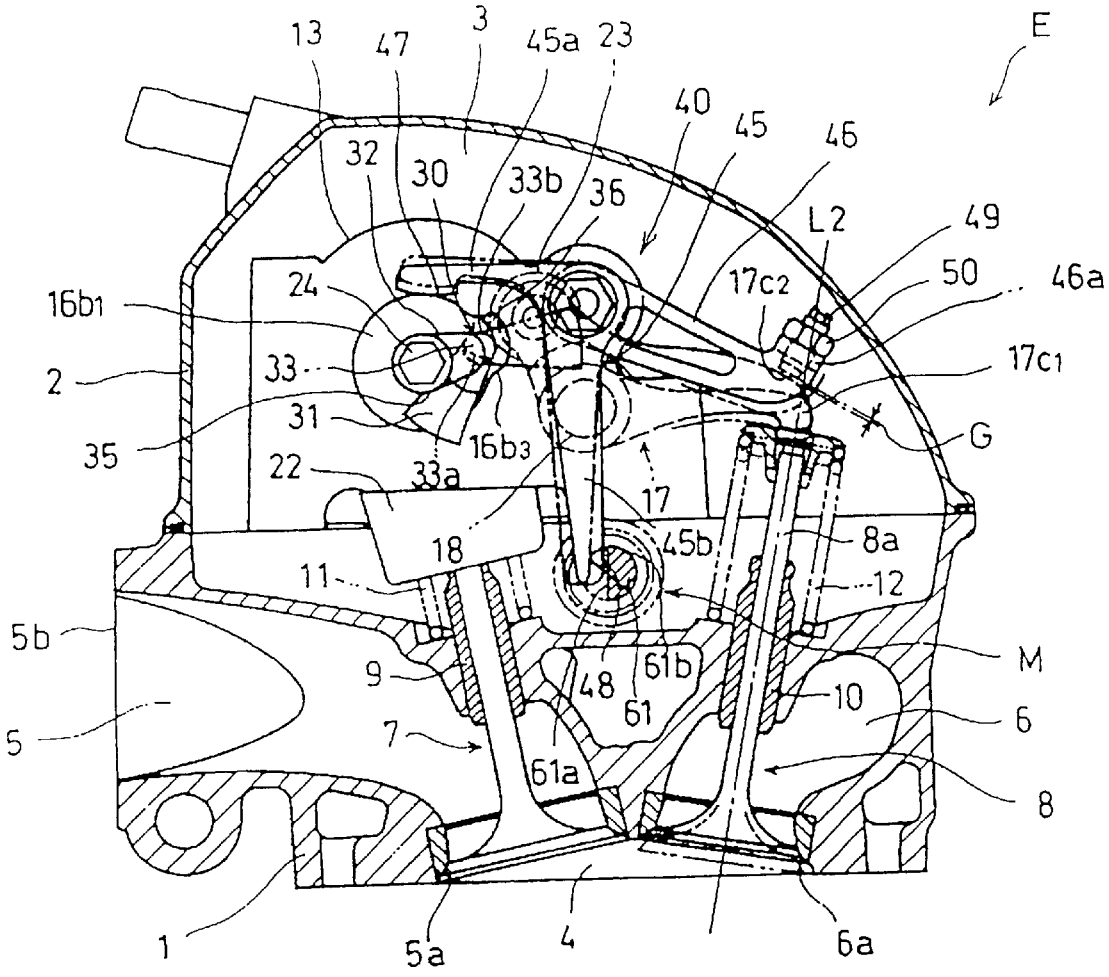
FIG. 1 is a vertical cross-sectional view of an internal combustion engine to which the decompression unit of the present invention is applied, when viewed from the right side.

An internal combustion engine E to which the decompression unit of the present invention is applied is an overhead camshaft single cylinder reciprocating 4-cycle internal combustion engine to be mounted on the motorcycle. As shown in FIG. 1, a cylinder head 1 for connecting to the upper end surface of the cylinder block (not shown) includes a cylinder in which a piston (not shown) is fitted for a reciprocating motion is connected to the head cover 2 to form a valve driving chamber 3 in which the valve driving unit that will be described later is stored. The cylinder head 1 is formed with an air intake port 5 having a pair of inlets 5*a* opening toward a combustion chamber 4 formed between the piston and the cylinder head 1 at the rear portion of the vehicle body (left side of the FIG. 1). An exhaust port 6 is provided having a pair of outlets 6*a* opening toward the combustion chamber 4 at the front portion of the vehicle body (right side of FIG. 1). A pair of air intake valves 7 and a pair of exhaust valves 8 for opening and closing both of the inlets 5*a* and both of the outlets 6*a*, respectively, are slidably fitted into the valve sleeves 9, 10 press-fitted into the cylinder head 1, respectively. A spring force of each valve spring 11, 12 urges each air intake valve 7 to close the corresponding inlet 5*a* and each exhaust valve 8 to close the corresponding outlet 6*a*. An air intake pipe to which a carburetor forming an air-fuel mixture for being supplied to the combustion chamber 4 is connected to an upstream opening 5*b* of the air intake port 5. An exhaust pipe for exhausting combustion gas from the combustion chamber 4 is connected to a downstream opening of the exhaust port 6.

Figure 2:
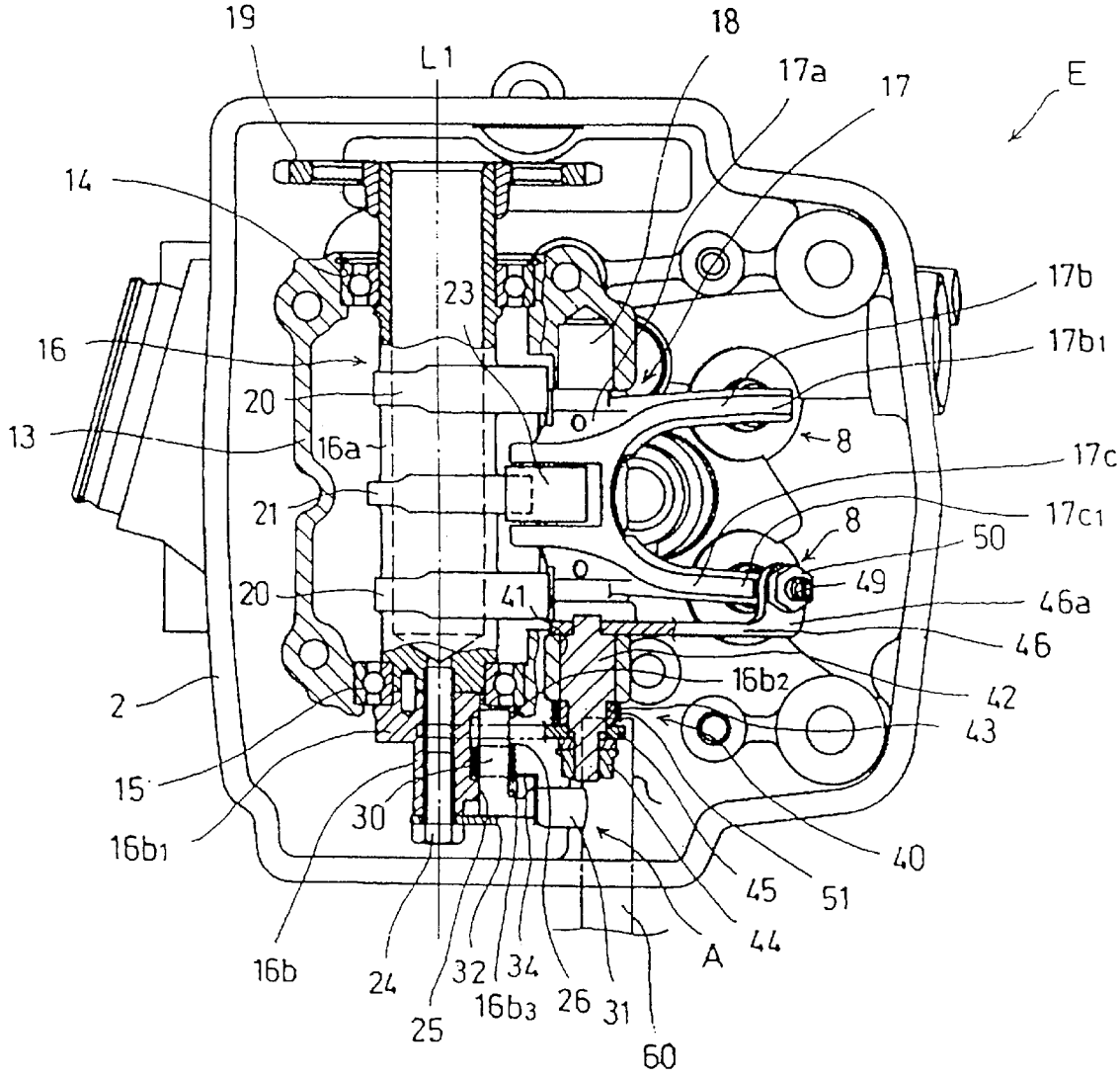
FIG. 2 is a plan view, partly in cross section, of the internal combustion engine of FIG. 1, showing a state in which the head cover is removed.

Referring now to FIG. 2, the valve driving unit comprises a camshaft 16 rotatably supported on a cam holder 13 secured to the cylinder head 1 with a bolt by a pair of left and right (upper and lower in FIG. 2) bearings 14, 15 constructed of ball bearings. A pair of lifters (not shown) are provided for opening and closing a pair of air intake valves 7, respectively. A single rocker arm 17 is provided for opening and closing a pair of exhaust valves 8, respectively. A rocker shaft 18 includes an axis in parallel with the axis of revolution L1 of the camshaft 16 and fixed to the cam holder 13 for supporting the rocker arm 17 for a pivotal motion.

The camshaft 16 has an axis of revolution in parallel with the axis of revolution of the crankshaft that is revolved by the piston, and revolves at half the number of revolutions of the crankshaft by the power of the crankshaft transmitted via a timing chain routed between a drive sprocket connected to the crankshaft and a cam sprocket 19 connected to the left end of the camshaft 16.

The camshaft 16 is formed with a pair of air intake cams 20 having prescribed identical cam surfaces, and a single exhaust cam 21 having a prescribed cam surface at about the center between both of the air intake cams 20. A pair of air intake cams 20 are brought into sliding contact with the top surface of the lifter being slidably fitted into the guide tube 22 formed on the cam holder 13, and the lifter is slid along the cam surface so that both of the air intake valves 7 are opened and closed at the prescribed opening-and-closing timings by the prescribed lifting amounts.

On the rocker arm 17, a roller 23 that is in rolling contact with the exhaust cam 21 is rotatably held on one side and first and second branches 17*b*, 17*c* bifurcated into the shape of the letter U that are formed on the other side with respect to the supporting portion 17*a* through which the rocker shaft 18 is passed. The extremities $17b_1$, $17c_1$ of the respective branches 17*b*, 17*c* abut against the end surface of the valve stem 8*a* of the exhaust valve 8. Then, the exhaust cam 21 pivots the rocker arm 17 via the roller 23 being abutted along the cam surface, so that both of the exhaust valves 8 are opened and closed at the prescribed opening-and-closing timings by the prescribed lifting amounts.

The decompression unit for mounting on the internal combustion engine E includes a kick-starting unit (not shown) that will be described. The decompression unit constructs the right end portion of the camshaft 16 and comprises a rotating member 16*b* to be secured to the camshaft body 16*a* with a bolt 24, a first operating member A is rotatably supported by the rotating member 16*b*. A controlling member is provided for controlling the operation of the first operating member A. A decompression arm 40 is supported by the cam holder 13 for a pivotal motion, a resilient member, and a second operating member M.

The rotating member 16*b* is formed with a resting cam portion $16b_1$ having a cylindrical surface with an central axis corresponding to the axis of revolution L1, on which a follower 47 formed at one end of the decompression arm 40 abuts, and there are formed on a part of the cylindrical surface with a pair of projections $16b_2$, $16b_3$ radially projecting at a space therebetween in the axial direction. The resting cam portion $16b_1$ is formed with a bearing hole 25 having a central axis in parallel with the axis of revolution L1 in a state in which a part thereof is located between the projections $16b_2$, $16b_3$. Therefore, the portion of the bearing hole 25 located between the projections $16b_2$, $16b_3$ serves as an opening 26 opening radially outwardly. The portion of the peripheral wall surface of the bearing hole 25 facing towards the opening 26 that is radially inside thereof is formed with a recess for accommodating a controlling spring 34 that will be described later.

The first operating member A is slidably fitted in the bearing hole 25, and is constructed of a cylindrical shaft portion 30 having an axis of rotation corresponding to the central axis of the bearing hole 25, and a centrifugal weight portion 31. The axial movement of the shaft portion 30 is limited by the bearing 15 and is able to abut against the left end surface of the shaft portion 30. The plate 32 is able to abut against the right end surface of the shaft portion 30 and is secured with a bolt 24, so that the first operating member A is prevented from coming off the rotating member 16*b*.

The portion of the shaft portion 30 supported in the bearing hole 25 is exposed from the opening 26 and is formed with a first decompression cam 33 to which the follower 47 abuts. The first decompression cam 33 has a cam surface comprising a releasing portion 33*a* being positioned on the route of a sliding contact of the follower 47 on the resting cam portion $16b_1$ and is formed of a bottom surface of the cut-off channel formed by cutting a portion of the cylindrical outer peripheral surface of the shaft portion 30 along the route of sliding contact so as to have a larger width than the width of the route of sliding contact in the axial direction. An operating portion 33*b* is formed of a cylindrical surface on the shaft portion 30 that projects radially outwardly from the cylindrical surface within the circumferential range of the opening 26 by a prescribed extent. The releasing portion 33*a* is formed into a surface having almost the same curvature as the cylindrical surface of the shaft portion 30 having a centerline corresponding to the axis of revolution of the shaft portion 30. Therefore, the operating portion 33*b* of the first decompression cam 33 projects radially outwardly from the cylindrical surface of the resting cam portion $16b_1$ from the opening 26, while the releasing portion 33*a* is positioned on the identical surface with the cylindrical surface of the operating portion 33*b*. The circumferential position of the first decompression cam 33 on the rotating member 16*b*, which is also a camshaft 16, in other words, the phase thereof is determined so that the follower 47 abuts against the first decompression cam 33 within a prescribed angular range until the piston in the compression stroke reaches the upper dead point.

The centrifugal weight portion 31 is formed integrally with the shaft portion 30 so as to project radially outwardly at the right end portion of the shaft portion 30, which is closer to the plate 32 than to the projection $16b_3$. The centrifugal weight portion 31 is, in this embodiment, shaped like a sector when viewed in the direction of the axis of the shaft portion 30, and the surface thereof on one side of the direction of rotation is urged into abutment with the stopper on the low revolution side 35 formed on the rotating member 16*b* by a torsional spring force of the controlling spring 34 formed of a helical torsion spring fitted on the outer periphery of the portion of the shaft portion 30 positioned between both of the projections $16b_2$, $16b_3$. The surface of the centrifugal weight portion 31 on the other side of the direction of rotation abuts against the side stopper on the high revolution side 36 formed on the right projection $16b_3$ located at the position nearer to the centrifugal weight portion 31 after the number of revolutions of the engine increases, and the first operating member A is rotated about the axis of revolution over the predetermined number of revolutions, which is a number of revolutions of the engine at the startup of the internal combustion engine E.

The controlling spring 34 serves to determine the number of revolutions of the engine at which the first operating member A rotates with the rotating member 16*b*, which is a part of the camshaft 16, and the first operating member A starts rotation by a centrifugal force generated at the centrifugal weight portion 31 against a torsional spring force of the controlling spring 34. Thus, by adjusting a torsional spring force of the controlling spring 34, the number of revolutions of the engine at the moment when the decompressing operation of the decompression unit is released is set. Therefore, the controlling spring 34 is a controlling member for controlling the decompressing operation of the decompression unit.

The decompression arm 40 comprises a supporting shaft 42 slidably fitted in the bearing hole 41 formed on the cam holder 13 at the position above the rocker shaft 18 and having a central axis for a pivotal motion in parallel with the axis of revolution L1. A first L-shaped arm plate 45 is clamped and fixed between a collar 43 mounted at the right end of the supporting shaft 42 for positioning in the axial direction and the nut 44 is screwed on the threaded portion. A second arm plate 46 is press-fitted and fixed on the left end of the supporting shaft 42. In the first arm 45, at the extremity of the first arm strip 45*a* extending towards the resting cam portion $16b_1$ on the opposite side of the supporting shaft 42 which has branches 17*b*, 17*c*, there is formed a follower 47 against which the resting cam portion $16b_1$ and the first decompression cam 33 abut. At the extremity of the second arm strip 45*b* bent at almost a right angle with respect to the first arm strip 45*a* and extending from the supporting shaft 42 radially toward the cylinder head 1, there is formed an abutting portion 48 against which the second decompression cam 61, which will be described later, of the second operating member M abuts.

On the other hand, the second arm 46 extends radially from the supporting shaft 42 along the second branch 17*c* of the rocker arm 17 towards the valve stem 8*a* of the exhaust valve 8. Then the extremity 46*a* thereof is bent so that it takes the position farther from the extremity of the valve stem 8*a* in comparison with the extremity $17c_1$ of the second branch 17*c*, that is, above the extremity $17c_1$ in this embodiment, but lapped over the extremity $17c_1$ when viewed in the direction of the center axis L2 of the valve stem 8*a*. A gap G is defined between both of the extremities $17c_1$, 46*a* in the direction of central axis L2. At the extremity 46*a*, an adjusting screw 49 that is to be engaged into the screw hole is engaged so that the axial position can be adjusted, and the adjusting screw 49 is fixed via the nut 50 after being adjusted to the predetermined position. The predetermined position is determined so that a minute gap G of a prescribed width is defined between the adjusting screw 49 and the abutting portion $17c_2$ of the upper surface of the second branch 17*c* against which the adjusting screw 49 abuts, or so that no gap G is formed between them, in a state in which the decompression arm 40 is pressed against the resting cam portion $16b_1$ and the releasing portion 33*a* of the first decompression cam 33 by the return spring 51 that will be described later, and the exhaust valve 8 is opened.

Since the adjusting screw 49 is a component that abuts against the abutting portion $17c_2$ of the second branch 17*c* and presses the same to pivot the rocker arm 17 in the direction to open the exhaust valve 8 when the decompression arm 40 is pivoted by the operating portion 33*b* of the first decompression cam 33 and the operating portion 61*b* of the second decompression cam 61 as will be described later, it is an adjusting member of the decompression arm 40 that constitutes a pressing portion for pressing the rocker arm 17 and adjusts the gap G defined with respect to the abutting portion $17c_2$ of the rocker arm 17.

The decompression arm 40 is urged so that the follower 47 abuts against the resting cam portion $16b_1$ and the first decompression cam 33 by a torsional spring force of the return spring 51 as a resilient member formed of a helical torsion spring fitted on the outer periphery of the collar 43. When the follower 47 abuts against the operating portion 33*b* of the first decompression cam 33, the decompression arm 40 is pivoted against a torsional spring force of the return spring 51, and the rocker arm 17 is pressed by the adjusting screw 49 and pivoted in the direction to open the exhaust valve 8. When the follower 47 abuts against the releasing portion 33*a* or the resting cam portion $16b_1$, the decompression arm 40 is pivoted in the opposite direction by a torsional spring force of the return spring 51.

The second operating member M comprises a cylindrical decompression shaft 60 extending through the through hole formed on the right wall, which is a wall of the cylinder head 1 nearer to the rotating member 16*b* in the direction of the axis of the cam shaft 16, into the valve driving chamber 3, and a second decompression cam 61 provided at the extremity of the decompression shaft 60 positioned in the valve driving chamber 3. The decompression shaft 60 is linked to the operating portion, which is to be operated by a driver outside the cylinder head 1, via a link mechanism not shown. The second decompression cam 61 comprises a releasing portion 61*a* which is a flat surface formed by cutting a part of the decompression shaft 60 along the plane in parallel with the axis of the decompression shaft 60 from the end surface of the decompression shaft 60. An operating portion 61*b* is a cylindrical surface of the decompression shaft 60. When the decompressing operation is in the released state in which the operating portion is located at the position where the decompressing operation is released and the follower 47 is in contact with the resting cam portion $16b_1$ or the releasing portion 33*a* of the first decompression cam 33, the releasing portion 61*a* of the second decompression cam 61 faces toward the abutting portion 48 of the second arm strip 45*b* with a gap interposed therebetween. When the operating portion is moved to the position of a decompressing operation, the decompression shaft 60 is rotated so that the operating portion 61*b* abuts against the abutting portion 48 as shown by a chain double-dashed line in FIG. 1. As a consequent, the decompression arm 40 is pivoted against a torsional spring force of the return spring 51, and the rocker arm 17 is pressed and pivoted by the adjusting screw 49 of the decompression arm 40, so that the decompressing operation that opens the exhaust valve 8 is performed.

The operation and effects of the embodiment constructed as explained so far will now be described.

As shown by a solid line in FIG. 1, when the internal combustion engine E is shut down, the centrifugal weight portion 31 is at the first position in which it abuts against the stopper 35 on the low revolution side by a torsional spring force of the controlling spring 34, the first decompression cam 33 is at the operating position in which the operating portion 33*b* is located at the opening 26, and the second decompression cam 61 is at the releasing position in which the releasing portion 61*a* faces toward the abutting portion 48 of the second arm strip 45*b* with a gap interposed therebetween. Since the follower 47 of the decompression arm 40 is abutting against the resting cam portion $16b_1$ by a torsional spring force of the return spring 51, the adjusting screw 49 of the decompression arm 40 does not press the exhaust valve 8 toward the opening direction, and the exhaust valve 8 closes the outlet 6*a* by a spring force of the valve spring 12.

When the kick-starting unit is operated for starting the internal combustion engine E, the power of the crankshaft is transmitted to the camshaft 16 via the timing chain, and the camshaft 16 revolves, and the first operating member A is integrally revolved with the camshaft 16. When the number of revolutions of the engine is not more than the predetermined number of revolutions, a centrifugal force generated at the centrifugal weight portion 31 by the revolution of the camshaft 16 is low. Therefore, the centrifugal weight portion 31 and thus the first operating member A is kept as is the case where the internal combustion engine E is shutdown by a torsional spring force of the controlling spring 34.

Figure 3:
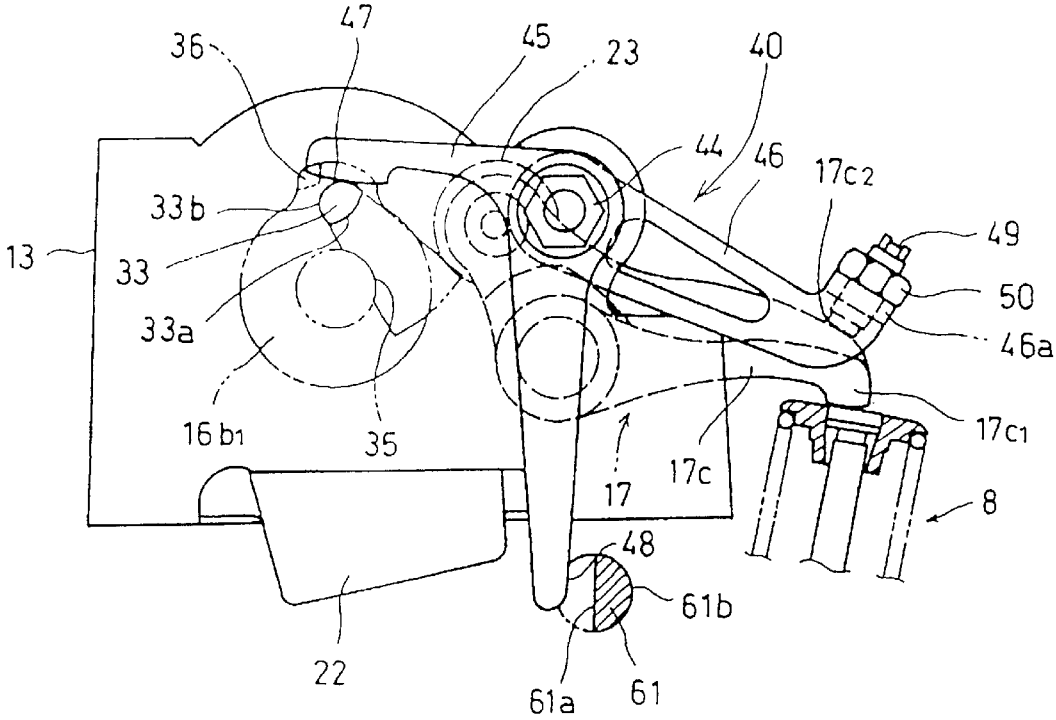
FIG. 3 is an explanatory drawing showing a decompression unit of FIG. 1 during decompressing operation.

In this state, during the compression stroke of the internal combustion engine E, the follower 47 abuts against the operating portion 61*b* of the second decompression cam 61 located at the operating position to pivot the decompression arm 40, and the adjusting screw 49 presses the abutting portion $17c_2$ of the second branch 17*c* from above, as shown in FIG. 3. Accordingly, the rocker arm 17 is pivoted to the position corresponding to the predetermined amount of projection of the operating portion 33*b* of the first decompression cam 33, and both of the exhaust valves 8 are opened at the opening-and-closing timings for the valve opening period by a lifting amount corresponding to the gap G that is set by the adjusting screw 49, and the decompressing operation to release the compressed pressure in the cylinder to reduce the pressure therein is performed. On the other hand, the exhaust cam 21 opens and closes both of the exhaust valves 8 at the opening-and-closing timings by the lifting amount corresponding to the cam surface via the rocker arm 17 irrespective of the decompression arm 40.

Figure 4:
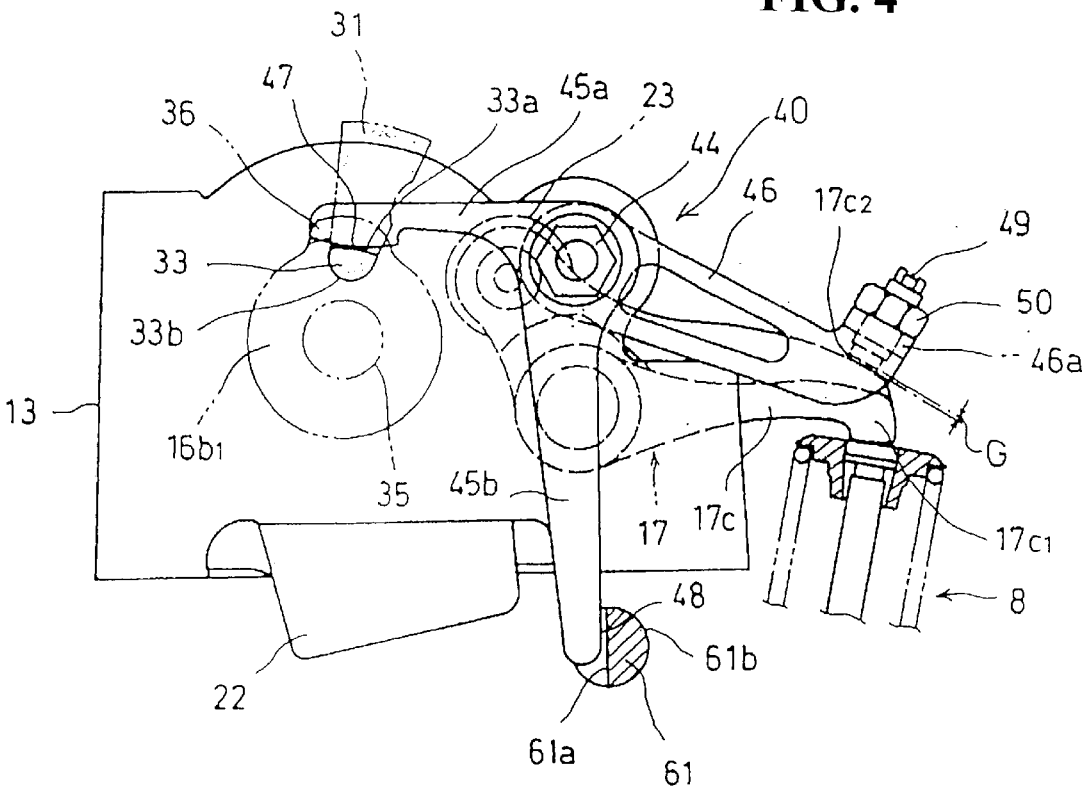
FIG. 4 is an explanatory drawing showing a decompression unit of FIG. 1 when the decompressing operation is released.

When the number of revolutions of the engine exceeds the predetermined number of revolutions, a centrifugal force generated at the centrifugal weight portion 31 overcomes a torsional spring force of the controlling spring 34. Therefore, the centrifugal weight portion 31 and thus the first operating member A rotates in the counter-clockwise direction in FIG. 3 against the torsional spring force. As shown in FIG. 4, the centrifugal weight portion 31 takes the second position in which the centrifugal weight portion 31 abuts against the stopper 36 on the high revolution side.

At this moment, the first decompression cam 33 is at the releasing position in which the releasing portion 33*a* is located at the opening 26, and the follower 47 abuts against the releasing portion 33*a*. Therefore, the decompression arm 40 is not pivoted during the compression stroke of the internal combustion engine E, and thus the decompressing operation is released in which the exhaust valve 8 is not opened even when the decompression arm 40 pivots the rocker arm 17. In this case as well, the exhaust cam 21 opens and closes both of the exhaust valves 8 at the opening-and-closing timings by the lifting amount corresponding to the cam surface via the rocker arm 17 irrespective of the decompression arm 40.

When the internal combustion engine E is started at the number of revolutions exceeding the predetermined number of revolutions, an accidental fire may occur due to fuel attached on the ignition plug by a concentrated air-fuel mixture supplied to the combustion chamber 4. In such a case, since the first decompression cam 33 of the first operating member A is in a state in which the decompressing operation is released, the second operating member M is operated to rotate the second decompression cam 61 to the operating position in which the operating position 61*b* of the second decompression cam 61 abuts against the abutting portion 48 of the second arm strip 45*b*. As a result, the decompression arm 40 is pivoted and then the rocker arm 17 is also pivoted via the adjusting screw 49 to allow the decompressing operation for opening both of the exhaust valves 8 to be performed. Therefore, an unburned air-fuel mixture in the cylinder is scavenged quickly and the normal operating condition in which restarting is possible may be restored.

A torsional spring force, which is a resilient force of the return spring 51, acts to allow the decompression arm 40 to move away from the rocker arm 17, in other words, to allow the decompression arm 40 to pivot counter-clockwise in FIG. 4. Therefore, the decompression arm 40 is pivoted with the rocker arm 17 to pivot the rocker arm 17 only when it is pivoted by the first decompression cam 33 located at the operating position, and the decompression arm 40 does not pivot with the rocker arm 17 when the rocker arm 17 is pivoted by the exhaust cam 21. Therefore, since the decompression arm 40 is pivoted with the rocker arm 17 only when it is pivoted by the first and the second decompression cams 33, 61 during decompressing operation, and it is not pivoted when the rocker arm 17 is pivoted by the exhaust cam 21 and when the decompressing operation is released, the equivalent inertia weight of the valve driving system comprising a rocker arm 17 and the like for opening and closing the exhaust valve 8 does not increase even when the decompression arm 40 is provided, and thus the followability in the opening-and-closing action of the exhaust valve 8 with respect to the exhaust cam 21 is satisfactory when the internal combustion engine E is operated at high-revolution speeds, which may prevent the engine output from being lowered.

Since the number of revolutions at which the decompression arm 40 is pivoted is the number of revolutions not more than the predetermined number of revolutions of the internal combustion engine E during startup, which belongs to the extremely low revolution range in the operational revolution range of the internal combustion engine E, requirements for rigidity of the decompression arm 40 are not strict, and since abrasion caused by contact with the rocker arm 17 is seen only during the decompressing operation, requirements for abrasion resistance are not strict as well. Therefore, the cost of the decompression unit can be reduced by using less expensive materials or by omitting the surface treatment while ensuring the durability.

In the operational revolution range in which the decompressing operation by the first decompression cam 33 is released, the second decompression cam 61 that is to be operated manually by a driver can be used to perform the decompressing operation. Therefore, when a state in which unburned air-fuel mixture exists in the combustion chamber 4 due to an accidental fire or the like as described above occurs, the unburned air-fuel mixture can be scavenged quickly from the cylinder by the decompressing operation by the second decompression cam 61, and thus the normal operating state, such as restarting, may be quickly restored.

In addition, since the decompression arm 40 is used in common in the automatic decompressing operation by the first operating member A based on the number of revolutions of the engine and the manual decompressing operation by the second operating member M, the decompression unit that is to be operated automatically and manually may be downsized and the weight thereof may be reduced, and thus the cost may be reduced.

Since the decompression arm 40 is always urge to be abutted against the resting cam portion $\mathbf{16}b_1$ and the first decompression cam 33 by a torsional spring force of the return spring 51 and thus the decompression arm 40 is in the almost fixed state, and a gap is defined between the second decompression cam 61 and the abutting portion 48 of the decompression arm 40 when the second decompression cam 61 is in the releasing position, noise caused by contact between them due to vibration of the internal combustion engine E may be prevented.

Since the gap G between the adjusting screw 49 and the abutting portion $\mathbf{17}c_2$ of the rocker arm 17 can be adjusted by the position-adjustable adjusting screw 49 provided on the decompression arm 40, the opening-and-closing timings, the valve opening period, and the lifting amount of the exhaust valve 8 by the decompression arm 40 may easily be adjusted during the decompressing operation. Therefore, the optimal decompressing operation can be performed for each internal combustion engine E, and the decompression unit can be used in common for a variety of internal combustion engines, which enables a cost reduction by mass production of the decompression unit.

In addition, when the position of the adjusting screw 49 is set so that a minute gap G is defined between the adjusting screw 49 and the abutting portion $\mathbf{17}c_2$ of the second branch 17*c* when the decompression arm 40 is pressed against the resting cam portion $\mathbf{16}b_1$ and the releasing portion 33*a* of the first decompression cam 33 and the exhaust valve 8 is closed, the rocker arm 17 never comes into contact with the decompression arm 40 when the decompressing operation is released. Therefore, abrasion of the decompression arm 40 due to contact with the rocker arm 17 is prevented, the thus the durability may be improved.

Another embodiment, which is provided by making a partial modification to the above-described embodiment, will now be illustrated regarding the modified construction.

Though the follower 47 of the decompression arm 40 is brought into contact with the resting cam portion $\mathbf{16}b_1$ in the above-described embodiment, it is also possible to provide a roller that comes into rolling contact with the cylindrical surface of the resting cam portion $\mathbf{16}b_1$ rotatably on the decompression arm 40 instead of the follower 47. Alternatively, though both of the pair of exhaust valves 8 are opened and closed by the single rocker arm 17, they may be opened and closed separately by a pair of rocker arms that are pivoted respectively by a pair of exhaust cams. In this case, only one of the exhaust valves 8 is opened and closed by the decompression arm 40. The camshaft body 16*a* and the rotating member 16*b* may be formed by integral molding.

Though the exhaust valve 8 is opened and closed by the decompression arm 40 in the above-described embodiment, the decompressing operation can be performed by providing an air intake rocker arm for opening and closing the air intake valve so that the air intake valve is opened and closed by pressing the air intake rocker arm by the decompression arm. In this case, it may be constructed in such a manner that the air intake rocker arm is a single rocker arm having two branches like the rocker arm 17 in the above-described embodiment, and the exhaust valve is opened and closed by a lifter.

Though the pressing portion is formed of an adjusting screw 49 in the above-described embodiment, it is also possible to construct in such a manner that the extremity of the second arm 46 itself abuts against the rocker arm 17 without providing the adjusting screw 49. Alternatively, though the decompression arm 40 is of a follower type in which the follower 47 provided on the first arm 45 abuts against the first decompression cam 33, it may be a roller type in which a roller is rotatably provided on the first arm 45 and the roller is brought into abutment against the first decompression cam 33.

Though the starting unit is a kick-starting unit, which is a manually operated starting unit, it may be a starting unit using a starter motor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine including an air intake valve and an exhaust valve wherein a rocker arm is pivoted by a cam provided on a cam shaft driven by a crankshaft for opening and closing the air intake valve or the exhaust valve and including a decompression unit comprising:

a first decompression cam for assuming an operating position when the number of revolutions of the engine is not more than a predetermined number of revolutions during startup;

a decompression arm being supported by the internal combustion engine for a pivotal motion and having a first abutting portion for abutting against the first decompression cam and a pressing portion for pressing the rocker arm; and a resilient member applying a resilient force so that the first abutting portion of the decompression arm is brought into abutment against the first decompression cam;

said decompression arm being pivoted by the first decompression cam located at the operating position against the resilient force for allowing the rocker arm to pivot via the pressing portion for opening the air intake valve or the exhaust valve.

2. The decompression unit for an internal combustion engine according to clam 1, wherein the decompression unit comprises a second decompression cam for manual operation, the decompression arm includes a second abutting portion that abuts against the second decompression cam, and the decompression arm is pivoted against the resilient force by the above-described second decompression cam located at the operating position for pivoting the rocker arm via the pressing portion to open the air intake valve or the exhaust valve.

3. The decompression unit for an internal combustion engine according to claim 1, wherein the pressing portion includes an adjusting member for adjusting the space with respect to the abutting portion of the rocker arm that abuts against the pressing portion.

4. The decompression unit for an internal combustion engine according to claim 2, wherein the pressing portion includes an adjusting member for adjusting the space with respect to the abutting portion of the rocker arm that abuts against the pressing portion.

5. The decompression unit for an internal combustion engine according to claim 1, and further including a centrifugal weight operatively connected to said cam shaft for imparting initial rotation thereto.

6. The decompression unit for an internal combustion engine according to claim 5, wherein said resilient member is a torsional spring that is selected is accordance with the centrifugal weight for determining the predetermined number of revolutions of said engine during startup.

7. The decompression unit for an internal combustion engine according to claim 5, wherein said centrifugal weight is formed integral with said cam shaft.

8. A decompression unit for an internal combustion engine having an air intake valve and an exhaust valve comprising:

a cam shaft;

a cam operatively mounted on said cam shaft;

a rocker arm pivotally connected to the cam provided on the cam shaft driven by a crankshaft for opening and closing the air intake valve or the exhaust valve;

a first decompression cam for assuming an operating position when the number of revolutions of the engine is not more than a predetermined number of revolutions during startup;

a follower operatively mounted for pivotal motion and having a first abutting portion for abutting against the first decompression cam and a pressing portion for pressing the rocker arm; and a resilient member for applying a resilient force wherein the first abutting portion of the decompression arm is brought into abutment against the first decompression cam;

said follower being pivoted by the first decompression cam located at the operating position against the resilient force for pivoting the rocker arm via the pressing portion for opening the air intake valve or the exhaust valve.

9. The decompression unit for an internal combustion engine according to clam 8, wherein the decompression unit includes a manually operated a second decompression cam, the follower includes a second abutting portion that abuts against the second decompression cam, and the follower is pivoted against the resilient force by the above-described second decompression cam located at the operating position for pivoting the rocker arm via the pressing portion to open the air intake valve or the exhaust valve.

10. The decompression unit for an internal combustion engine according to claim 8, wherein the pressing portion includes an adjusting member for adjusting the space with respect to the abutting portion of the rocker arm that abuts against the pressing portion.

11. The decompression unit for an internal combustion engine according to claim 9, wherein the pressing portion includes an adjusting member for adjusting the space with respect to the abutting portion of the rocker arm that abuts against the pressing portion.

12. The decompression unit for an internal combustion engine according to claim 8, and further including a centrifugal weight operatively connected to said cam shaft for imparting initial rotation thereto.

13. The decompression unit for an internal combustion engine according to claim 12, wherein said resilient member is a torsional spring that is operatively selected is accordance with the centrifugal weight for determining the predetermined number of revolutions of said engine during startup.

14. The decompression unit for an internal combustion engine according to claim 12, wherein said centrifugal weight is formed integral with said cam shaft.

* * * * *